US011187106B2

(12) United States Patent
DePaoli et al.

(10) Patent No.: US 11,187,106 B2
(45) Date of Patent: Nov. 30, 2021

(54) BEARING HEAT SHIELD

(71) Applicant: BorgWarner Inc., Auburn Hills, MI (US)

(72) Inventors: Dominic William DePaoli, Horse Shoe, NC (US); Aaron Burke Date, Asheville, NC (US); Tanner Leigh Brookshire, Asheville, NC (US); Daniel Thomas Pruitt, Arden, NC (US)

(73) Assignee: BorgWarner Inc., Auburn Hills, MI (US)

( * ) Notice: Subject to any disclaimer, the term of this patent is extended or adjusted under 35 U.S.C. 154(b) by 152 days.

(21) Appl. No.: 16/421,053

(22) Filed: May 23, 2019

(65) Prior Publication Data

US 2020/0370444 A1 Nov. 26, 2020

(51) Int. Cl.
*F01D 25/14* (2006.01)
*F01D 25/16* (2006.01)

(52) U.S. Cl.
CPC ..... *F01D 25/14* (2013.01); *F01D 25/16* (2013.01); *F05D 2220/40* (2013.01)

(58) Field of Classification Search
CPC ..... F01D 25/125; F16C 33/785
See application file for complete search history.

(56) References Cited

U.S. PATENT DOCUMENTS

| | | | | |
|---|---|---|---|---|
| 3,099,385 | A * | 7/1963 | Elford | F01D 25/166 417/407 |
| 3,106,381 | A * | 10/1963 | Leins | F01D 25/26 415/119 |
| 5,094,587 | A * | 3/1992 | Woollenweber | F01D 9/026 415/205 |
| 5,682,747 | A * | 11/1997 | Brown | F23R 3/10 60/746 |
| 5,954,343 | A | 9/1999 | Sumida et al. | |
| 7,004,478 | B2 | 2/2006 | Spence et al. | |
| 9,097,264 | B1 * | 8/2015 | Kennedy | F01D 9/026 |
| 10,934,867 | B2 * | 3/2021 | Takeda | F01D 9/026 |
| 2011/0014036 | A1 | 1/2011 | Boening et al. | |
| 2016/0102678 | A1 * | 4/2016 | Crandall | F02B 39/14 415/177 |
| 2020/0056505 | A1 * | 2/2020 | Sakamoto | F01D 25/125 |

* cited by examiner

*Primary Examiner* — Woody A Lee, Jr.
*Assistant Examiner* — Brian O Peters
(74) *Attorney, Agent, or Firm* — von Briesen & Roper, s.c.

(57) ABSTRACT

A bearing heat shield, a turbomachine having a bearing heat shield and method for assembling such is disclosed. The bearing heat shield includes an outer annular ring extending around an outer circumference of the bearing heat shield, the outer annular ring has a flat surface and extends inward from an outer diameter measurement to a middle diameter measurement. The bearing heat shield further includes a concave surface, the concave surface being defined by a curvature and extending inward from the middle diameter measurement to an inner diameter measurement.

18 Claims, 4 Drawing Sheets

BEARING HEAT SHIELD

TECHNICAL FIELD

The present disclosure generally relates to a bearing heat shield, and more specifically to a bearing heat shield for a turbomachine.

BACKGROUND

Turbomachines are used to enhance the performance of internal combustion engines. They are a type of forced induction system which delivers air to the engine intake at a greater density than is achievable in a typical aspirated configuration internal combustion engine. They are typically centrifugal compressors driven by exhaust-driven turbines. Exhaust gas from the engine drives the turbine to drive an impeller of the compressor. The compressor draws in ambient air, compresses the air, and then supplies this compressed air to the engine. In this manner, the engine may have improved fuel economy, reduced emissions, and high power and torque.

The high temperatures of exhaust gases often result in turbomachines including bearing heat shields to protect components of the turbomachine from overheating. However, the exhaust gases may interact with bearing heat shields to produce undesirable acoustic responses (e.g., humming, vibrations). As such, improved bearing heat shields are desired.

SUMMARY OF THE DISCLOSURE

In accordance with an embodiment, a bearing heat shield is disclosed. The bearing heat shield includes an outer annular ring extending around an outer circumference of the bearing heat shield, the outer annular ring having a flat surface and extending inward from an outer diameter measurement to a middle diameter measurement. The bearing heat shield further includes a concave surface, the concave surface defined by a curvature and extending inward from the middle diameter measurement to an inner diameter measurement.

In yet another embodiment, a turbomachine is disclosed. The turbomachine includes a turbine housing, a turbine wheel disposed in the turbine housing and configured to rotate about an axis, a bearing housing adjacent to the turbine housing; and a bearing heat shield disposed between the turbine housing and the bearing housing. The bearing heat shield includes an outer annular ring extending around an outer circumference of the bearing heat shield, the outer annular ring having a flat surface and extending inward from an outer diameter measurement to a middle diameter measurement. The bearing heat shield further includes a concave surface, the concave surface defined by a curvature and extending inward from the middle diameter measurement to an inner diameter measurement.

In yet another embodiment, a method is disclosed. The method includes obtaining a bearing heat shield, the bearing heat shield having an outer annular ring extending around an outer circumference of the bearing heat shield, the outer annular ring having a flat surface and extending inward from an outer diameter measurement to a middle diameter measurement, and a concave surface, the concave surface defined by a constant radius measurement and extending inward from the middle diameter measurement to an inner diameter measurement. The method further includes installing the bearing heat shield to a bearing housing and installing a turbine housing to sandwich the outer annular ring of the bearing heat shield between the bearing housing and the turbine housing.

While the following detailed description is given with respect to certain illustrative embodiments, it should be understood that the drawings are not necessarily to scale and the disclosed embodiments are sometimes illustrated diagrammatically and in partial view. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as equivalents thereto.

DETAILED DESCRIPTION

Referring now to FIGS. 1-6, this disclosure describes exemplary embodiments of a bearing heat shield 100 which is generally used in a turbomachine, such as the turbomachine 400, which may be realized by a turbocharger, an e-turbo, or the like. The turbomachine 400 may be used to enhance the performance of an internal combustion engine of an automobile, or the like.

Figure 1:
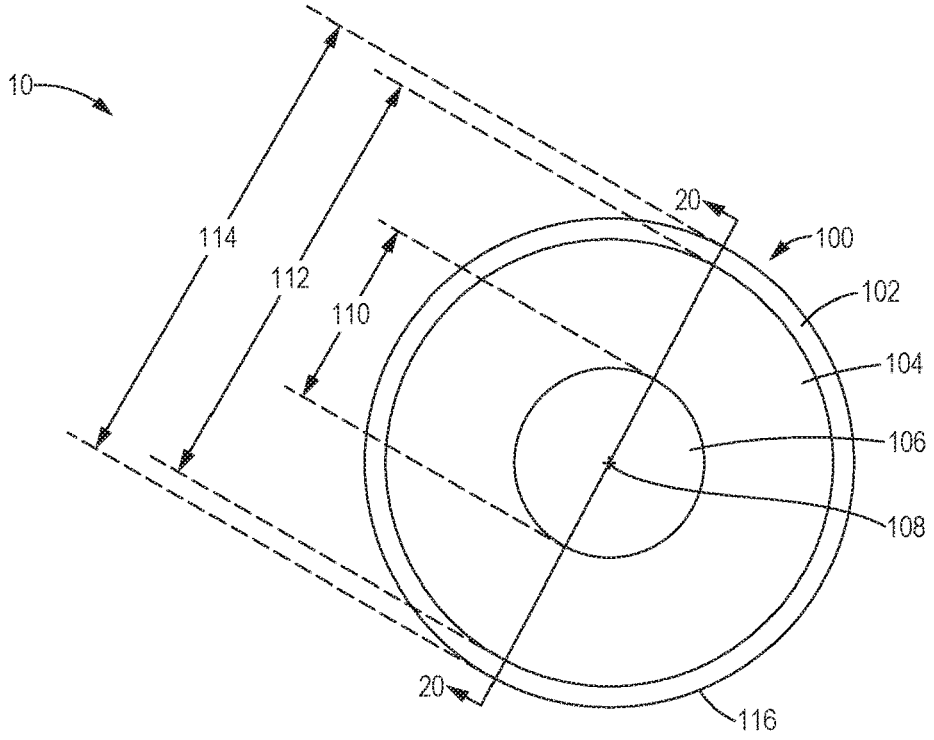
FIG. 1 is a front view of bearing heat shield, in accordance with an embodiment of the present disclosure.

Returning to FIG. 1, FIG. 1 depicts a front view of bearing heat shield, in accordance with an embodiment of the present disclosure. In particular, FIG. 1 depicts the front view 10 of the bearing heat shield 100. The bearing heat shield 100 includes an outer annular ring 102 that extends around an circumference 116 of the bearing heat shield 100. The outer annular ring may be realized as a flat surface that extends inward from an outer diameter measurement 114 to a middle diameter measurement 112. In some embodiments, the outer annular ring 102 serves to receive a compression force (e.g., a clamping force) from components of the turbomachine to maintain the bearing heat shield 100 in place in the turbomachine.

The bearing heat shield 100 further includes a concave surface 104. The concave surface is defined by a curvature 208, 210 (depicted in more detail in FIG. 2), and extends inward from the middle diameter measurement 112 to an inner diameter measurement 110. Thus, as seen in the front view 10 of FIG. 1, the concave surface 104 extends out of the page.

In some embodiments, the bearing heat shield 100 further includes an aperture 106 from the inner diameter measurement 110 to the center 108. The aperture 106 permits for turbocharger components (e.g., a shaft connecting a turbine wheel to a compressor wheel) to pass through.

Figure 2:
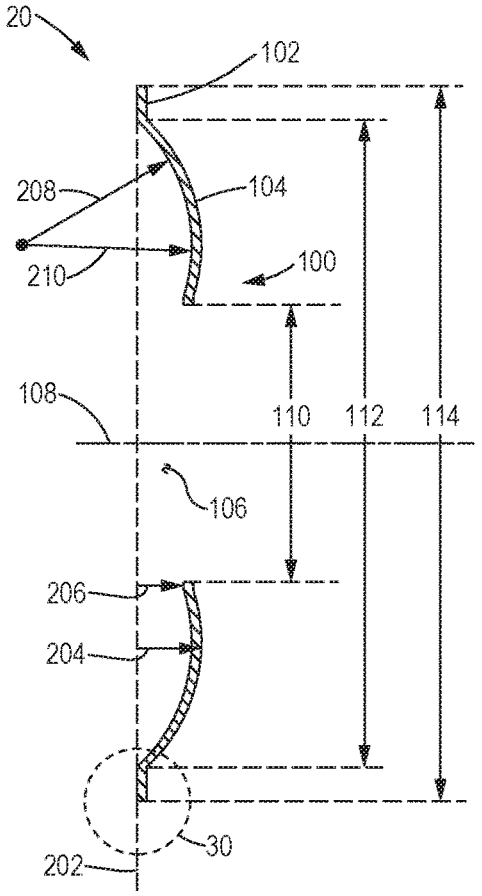
FIG. 2 is a cross-sectional view of the bearing heat shield of FIG. 1, in accordance with an embodiment of the present disclosure.

FIG. 2 is a cross-sectional view of the bearing heat shield of FIG. 1, in accordance with an embodiment of the present disclosure. In particular, FIG. 2 depicts the cross-sectional view 20 of the bearing heat shield 100 from FIG. 1. The concave surface 104 has a curvature 208, 210. Here, the curvature 208, 210 represent radius measurements of the concave surface 104. In some embodiments, the tightness of the curvature 208, 210 may vary across the concave surface 104. Yet in other embodiments, the curvature 208, 210 has a constant radius measurement at all points (e.g., the entire portion) of the concave surface 104 between the middle diameter measurement 112 and the inner diameter measurement 110. The curvature 208, 210 may be varied to obtain a desired resonant frequency of the bearing heat shield 100. However, it is envisioned that the entire concave surface 104 be curved, with no portion of the concave surface 104 being a flat surface.

As shown in the cross-sectional view 20, the bearing heat shield 100 further includes a reference plane 202. The reference plane 202 is defined by the outer annular ring 102.

This concave surface 104 results in the bearing heat shield 100 having different heights above the reference plane 202. For example, the concave surface 104 may have a maximum height 204 above the reference plane 202 at a location between the inner diameter measurement 110 and the middle diameter measurement 112. Further, after achieving the maximum height 204 while extending further inward towards the center 108, the height measurement of the concave surface 104 at the inner diameter measurement 110 may be at a height measurement 206 that is between the maximum height 204 and the reference plane 202. Thus, the concave surface 104 may curve back inwards towards the reference plane 202 as it extends inwards from the point of its maximum height 204 from the reference plane 202.

The concave surface 104 having the constant radius measurement provides for additional structural integrity of the bearing heat shield 100 and results in an increased resonant frequency, or a higher fundamental frequency, of the bearing heat shield 100 when at certain operating temperatures.

In some embodiments, the resonant frequency of the bearing heat shield 100 may be raised to at least 4 kHz under its operating parameters (e.g., temperature pressure). In yet other embodiments, the resonant frequency of the bearing heat shield 100 is between 4 kHz and 6.6 kHz. The increased resonant frequency may eliminate or reduce the undesirable effects that would occur when a resonant frequency of a conventional bearing heat shield is excited.

For example, operating conditions may result in a bearing heat shield 100 being exposed to excitations (e.g., from exhaust gasses) between 1 kHz and 2 kHz. This may result during cold-start conditions of an engine that the turbomachine 400 is installed within. Having a bearing heat shield 100 with a resonant frequency above 4 kHz above the 1 kHz and 2 kHz excitation range), prevents the bearing heat shield 100 from becoming excited to the point that the undesirable effects (e.g., vibrations, audible noise) are experienced.

Various aspects of the bearing heat shield 100 may be modified to further adjust the resonant frequency of the bearing heat shield 100 to have the desired response when it is installed within a turbomachine. In some embodiments, the ratio of the size of the outer annular ring 102, the concave surface 104, and the aperture 106 may be maintained. In one example, a first difference between the middle diameter measurement 112 and the inner diameter measurement 110 (e.g., corresponding to the concave surface 104) is between five to ten times a second difference between the outer diameter measurement 114 and the middle diameter measurement 110 (e.g., corresponding to the outer annular ring).

In another example, the middle diameter measurement 112 is between one to three times the inner diameter measurement 110 (e.g., corresponding to a ratio between the size of the concave surface 104 and the aperture 106)

In one such example of these ratios, the outer diameter measurement 114 is 60 units, the middle diameter measurement 112 is 55 units, and the inner diameter measurement 110 is 25 units. Thus, the first difference between the middle diameter measurement 112 and the inner diameter measurement 110 is 30 units, and the second difference between the outer diameter measurement 114 and the middle diameter measurement 110 is 5 units. This results in the first difference (30 units) being six times greater than the second difference (5 units). Further, the middle diameter measurement 112 of 55 units is 2.2 times greater than the inner diameter measurement 110 of 25 units.

Figure 3:
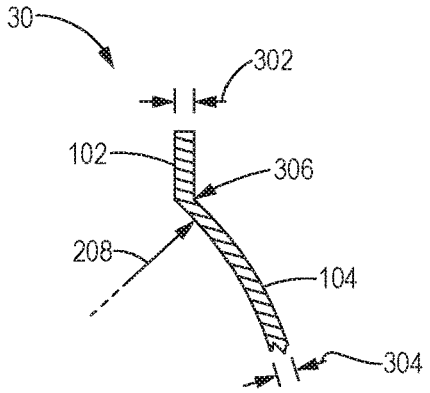
FIG. 3 is a detailed view of the cross-sectional view of the bearing heat shield of FIG. 2, in accordance with an embodiment of the present disclosure.

FIG. 3 is a detailed view of the cross-sectional view of the bearing heat shield of FIG. 2, in accordance with an embodiment of the present disclosure. In particular, FIG. 3 depicts the detailed view 30 from the cross-sectional view of FIG. 2. In the detailed view 30, a portion of the bearing heat shield 100 at the location of the middle diameter measurement 112 is depicted. Here, the outer annular ring 102 transitions to the concave surface 104 via the bend 306.

As depicted in FIG. 3, the bearing heat shield 100 has the thicknesses 302 and 304, which may be the same value. In some embodiments, the bearing heat shield 100 is manufactured from a flat piece of material (e.g., stainless steel, Inconel alloy, or any suitable material for use in a bearing heat shield). The bearing heat shield 100 may be stamped, or go though a progressive die stamping process to impart the curvature 208, 210 to the concave surface 104 of the bearing heat shield 100. As such, the thickness 302 of the outer annular ring 102 may be the same as the thickness 304 of concave surface 104, resulting in a uniform thickness of the bearing heat shield 100.

The thicknesses 302, 304 may be selected as a ratio of the diameters (e.g., 110, 112, 114), and further selected based on clamping tolerances of the various turbomachine components. Referring to the above example having the outer diameter measurement 114 being 60 units, the middle diameter measurement 112 being 55 units, and the inner diameter measurement 110 being 25 units, the thicknesses 302, 304 may be selected to between 0.5 and 1.5 units. In the preceding examples, the generic length term of 'units' may be substituted with a measurement of millimeters, centimeters, inches, or the like.

INDUSTRIAL APPLICABILITY

In general, the present disclosure may find applicability in many industries including, but not limited to, automobile, marine, and aerospace engines. When installed in a turbomachine, the bearing heat shield of the present disclosure limits the heat transfer from the hot exhaust gases to the bearing components of the turbomachine. Further, the designed natural frequency of the bearing heat shield 100 of the present disclosure reduces the adverse side effects of a conventional bearing heat shield being exposed to excitation frequencies from engine exhaust gases under certain operating conditions. For example, the designed natural frequency of the bearing heat shield 100 may be optimized for performance under cold start conditions. At higher engine operating speeds (and higher turbomachine operating speeds), a natural frequency of the bearing heat shield 100 may still be excited, however, the response may be masked by other sounds and vibrations associated with the higher engine operating speeds than as compared to the cold start conditions.

Figure 4:
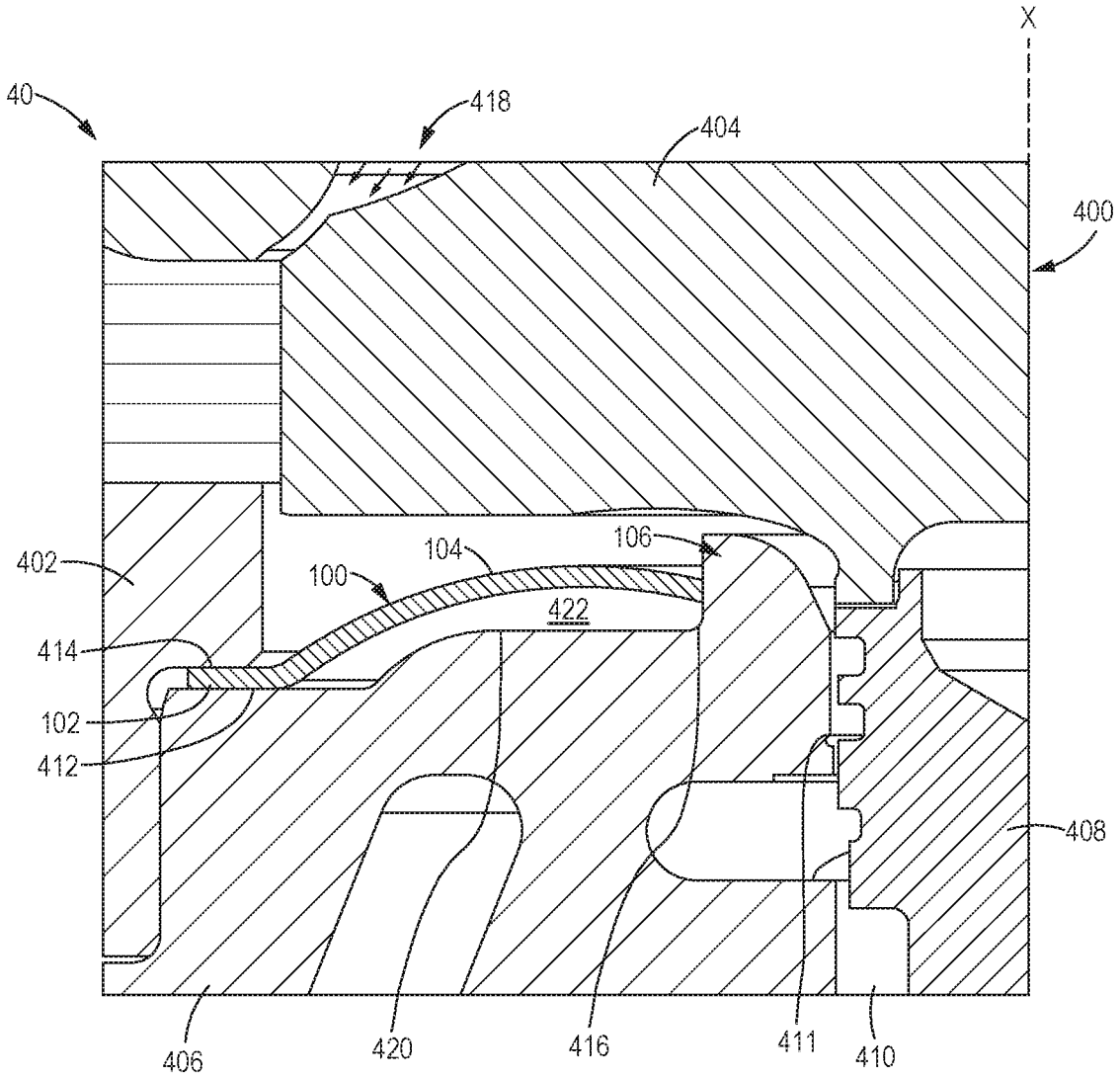
FIG. 4 is a cross-sectional view of a bearing heat shield installed in a turbomachine, in accordance with an embodiment of the present disclosure.

FIG. 4 is a cross-sectional view of a bearing heat shield installed in a turbomachine, in accordance with an embodiment of the present disclosure. In particular, FIG. 4 depicts the cross-sectional view 40 of the turbomachine 400 for an engine having the bearing heat shield 100 installed therein. In the exemplary embodiment, the turbomachine 400 includes a turbine housing 402, a turbine wheel 404, a bearing housing 406, a shaft 408, bearings 410, and a turbine wheel 404 having blades.

The turbine housing 402 is secured or mounted adjacent to the bearing housing 406. The shaft 408 is rotatably mounted, via the bearings 410 (e.g., journal bearings), in the bearing housing 406. Piston rings 411 are disposed between the shaft 408 and the bearing housing 406. The turbine wheel 404 is mounted on and rotates with the shall 408 about an X-axis. The X-axis may correspond with the center 108 of the bearing heat shield 100.

The turbine wheel 404 rotates and the exhaust gases 418 from the turbine wheel 404 interact with the bearing heat shield 100. This interaction between the exhaust gases 418 and the bearing heat shield 100 may occur at a frequency corresponding to the speed of the engine and the flow paths of the exhaust gases through the turbo-machinery.

The bearing heat shield 100 is disposed between the turbine housing 402 and the bearing housing 406. The bearing housing 406 includes an inner shoulder 412 and the turbine housing 402 includes an outer shoulder 414. The outer annular ring 102 of the bearing heat shield 100 may be sandwiched between the inner shoulder 412 of the bearing housing 406 and the outer shoulder 414 of the turbine housing 402. As such, a compressive force on the outer annular ring 102 from this sandwiching maintains the bearing heat shield in position within the turbomachine 400.

The inner diameter measurement 110 (e.g., the size of the aperture 106) may be selected so that the bearing heat shield 100 forms a press fit against a inside wall 416 of the bearing housing 406. In other embodiments, the inner diameter measurement 110 is selected so that the bearing heat shield 100 does not contact the inside wall 416 of the bearing housing 406.

As described above, the bearing heat shield 100 may include the outer annular ring 102 and the concave surface 104. Further, the bearing heat shield 100 includes an aperture 106 through which at least the shaft 408 extends. The bearing heat shield 100 may further include the design aspects discussed above, including at least the outer diameter measurement 114, the middle diameter measurement 112, the inner diameter measurement 110, the maximum height 204, the height measurement 206 at the inner diameter measurement 110, the thicknesses 302, 304, and the above-mentioned ratios. As such, the bearing heat shield 100 may have a resonant frequency at a value between 4 kHz and 6.6 kHz at desired operating temperatures.

Providing a bearing heat shield 100 having such a resonant frequency may reduce or eliminate audible noises produced when the exhaust gases 418 interact with a conventional bearing heat shield during cold start conditions.

When installed in the turbomachine 400, the concave surface 104 is spaced apart from the outer wall 420 such that an air gap 422 is formed between the bearing heat shield 100 and the bearing housing 406. The air gap 422 provides for thermal insulation between the exhaust gases 418 and the bearing components (e.g., bearings 410 and piston rings 411). The aperture 106 of the bearing heat shield 100 being press fit against the inside wall 416 may provide for sealing of the air gap 422. The concave surface 104 provides sufficient clearance between the bearing heat shield 100 and any changes of elevation of the height of the bearing housing outer wall 420.

Figure 5:
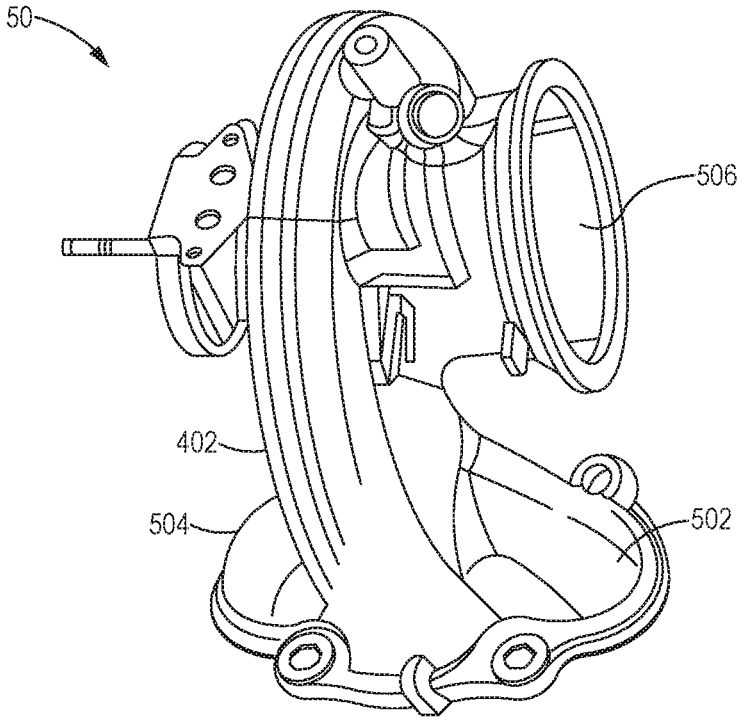
FIG. 5 is a perspective view of a turbine housing, in accordance with an embodiment of the present disclosure.

FIG. 5 is a perspective view of a turbine housing, in accordance with an embodiment of the present disclosure. In particular, FIG. 5 depicts the perspective view 50 of the turbine housing 402. The turbine housing 402 is a dual volute turbine housing having a first volute 502 and a second volute 504. The cavity 506 is provided to receive the turbine wheel 404 and to provide a flow path for the exhaust gases 418. In general, a dual volute turbomachine provides for a geometry that allows for the segregation of engine exhaust pulsations so more exhaust energy is available to the turbine wheel, compared with traditional twin-scroll turbochargers. The turbine housing 402 may be a part of the turbomachine 400 that includes the bearing heat shield 100 of the present disclosure.

Figure 6:
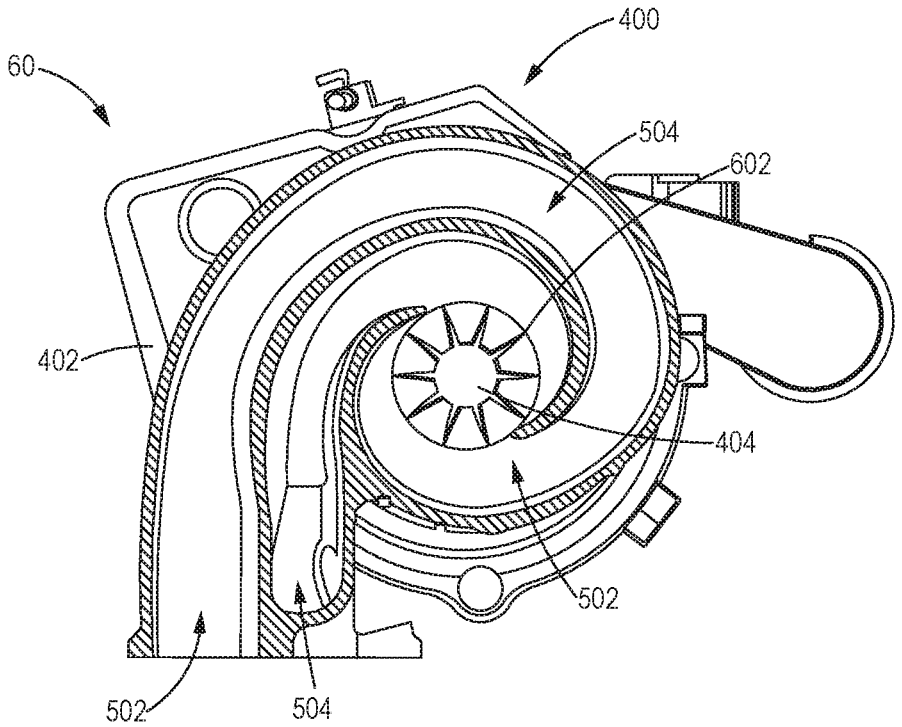
FIG. 6 is a cross-sectional view of the turbine housing of FIG. 5 and aspects of the turbomachine, in accordance with an embodiment of the present disclosure.

FIG. 6 depicts a cross-sectional view of the turbine housing of FIG. 5, in accordance with an embodiment of the present disclosure. In particular, FIG. 6 depicts the cross-sectional view 60 of the turbine housing 402 and portions of the turbomachine 400. Here, the turbine housing 402 includes the first volute 502 and the second volute 504. The first and second volutes 502, 504 direct exhaust gases from the engine (e.g., a gasoline powered engine) towards the blades 602 of the turbine wheel 404. The turbine wheel 404 may have ten blades 602. This dual volute flow path of exhaust gases 418 to the blades 602 may produce an excitation frequency on the bearing heat shield 100. Selection of a bearing heat shield 100 having a natural frequency above the excitation frequency for the given operating conditions (e.g., engine operating temperature and pressure) may result in eliminating or reducing adverse effects of the exhaust gases exciting the bearing heat shield 100. The increased natural frequency of the bearing heat shield 100 as compared to a conventional bearing heat shield may eliminate audible sounds and vibrations during cold start conditions. Any excitation of the bearing heat shield 100 at higher operating engine speeds may not be observable, or may be masked, by other sounds and vibrations present during the higher engine speeds.

Figure 7:
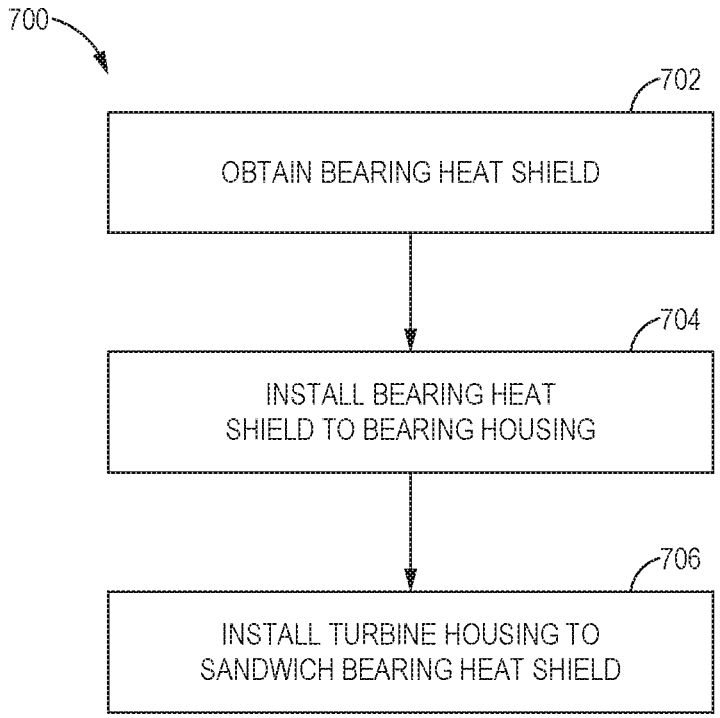
FIG. 7 depicts a method of assembling a turbomachine, in accordance with an embodiment of the present disclosure.

Also disclosed is a method of assembling a turbomachine 400 having a bearing heat shield 100. FIG. 7 depicts the method 700 of assembling the turbomachine. The method 700 includes obtaining the bearing heat shield 100 at 702, installing the bearing heat shield 100 to the bearing housing 406 at 704, and installing the turbine housing 402 to sandwich the bearing heat shield 100 between the bearing housing 406 and the turbine housing 402 at 706. The method 700 is described with the bearing heat shield 100 being installed into the turbomachine 400 by way of example.

At 702, a bearing heat shield 100 is obtained. The bearing heat shield 100 may be obtained by procuring the bearing heat shield 100 from a supplier, manufacturing the bearing heat shield, retrieving from inventory, or the like. The bearing heat shield 100 includes the outer annular ring 102 that extends around an outer circumference 116 of the bearing heat shield 100. The outer annular ring includes a flat surface and extends inward from the outer diameter measurement 114 to the middle diameter measurement 112. The bearing heat shield 100 further includes a concave surface 104, the concave surface is defined by a curvature 208, 210, and extends inward from the middle diameter measurement to an inner diameter measurement. Other aspects of the bearing heat shield 100 disclosed herein may also be included in the obtained bearing heat shield.

At 704, the bearing heat shield 100 is installed to the bearing housing 406. An aperture 106 of the bearing heat shield 100 may be press fit, or otherwise affixed, to an inside wall 416 of the bearing housing 406. This results in an air gap 422 being created between the bearing heat shield 100, the inside wall 416, and the outer wall 420.

At 706, a turbine housing 402 is installed to sandwich the outer annular ring 102 of the bearing heat shield 100 between the bearing housing 406 and the turbine housing 402. The outer annular ring 102 receives a compression force via the outer shoulder 414 of the turbine housing 402 and the inner shoulder 412 of the bearing housing 406.

The features disclosed herein may be particularly beneficial for use with various turbomachines 400. The novel embodiments disclosed herein limit the effects of an excitement frequency applied to the bearing heat shield 100 from the exhaust gases 418, thereby helping to reduce adverse noises and vibrations within an operating turbomachine 400.

What is claimed is:

1. A bearing heat shield comprising:

an outer annular ring extending around an outer circumference of the bearing heat shield, the outer annular ring having a flat surface and extending inward from an outer diameter measurement to a middle diameter measurement; and a concave surface, the concave surface defined by a curvature and extending inward from the middle diameter measurement to an inner diameter measurement, a first difference between the middle diameter measurement and the inner diameter measurement being between five to ten times a second difference between the outer diameter measurement and the middle diameter measurement, wherein the curvature is defined by a constant radius measurement through the entire concave surface.

2. The bearing heat shield of claim 1, further comprising an aperture from the inner diameter measurement to a center.

3. The bearing heat shield of claim 1, wherein the outer annular ring defines a reference plane, and the concave surface is at a maximum height above the reference plane between the middle diameter measurement and the inner diameter measurement.

4. The bearing heat shield of claim 3, wherein at the inner diameter measurement the concave surface has a height measurement between the maximum height and the reference plane.

5. The bearing heat shield of claim 1, wherein the bearing heat shield comprises a uniform thickness between the outer diameter measurement and the inner diameter measurement.

6. The bearing heat shield of claim 1, wherein the middle diameter measurement is greater than one times and less than three times the inner diameter measurement.

7. The bearing heat shield of claim 1, having a resonant frequency above 4 kHz.

8. The bearing heat shield of claim 7, further having the resonant frequency being below 6.6 kHz.

9. A turbo machine comprising:

a turbine housing;

a turbine wheel disposed in the turbine housing and configured to rotate about an axis;

a bearing housing adjacent to the turbine housing; and a bearing heat shield disposed between the turbine housing and the bearing housing, the bearing heat shield including:

an outer annular ring extending around an outer circumference of the bearing heat shield, the outer annular ring having a flat surface and extending inward from an outer diameter measurement to a middle diameter measurement; and a concave surface, the concave surface defined by a constant radius measurement and extending inward from the middle diameter measurement to an inner diameter measurement, wherein a first difference between the middle diameter measurement and the inner diameter measurement is between five to ten times a second difference between the outer diameter measurement and the middle diameter measurement, wherein:

a ratio of the outer diameter measurement to the middle diameter measurement is substantially 60:55;

a ratio of the middle diameter measurement to the inner diameter measurement is substantially 55:30 and a ratio of the outer diameter measurement to a thickness of the heat shield is substantially 60:1.

10. The turbomachine of claim 9, wherein the outer annular ring is sandwiched between the turbine housing and the bearing housing.

11. The turbomachine of claim 10, wherein the turbomachine further comprises the turbine housing having a dual volute.

12. The turbomachine of claim 11, wherein the bearing heat shield comprises a resonant frequency between 4 kHz and 6.6 kHz at an operating temperature of the turbomachine.

13. A method comprising:

obtaining a bearing heat shield, the bearing heat shield having:

an outer annular ring extending around an outer circumference of the bearing heat shield, the outer annular ring having a flat surface and extending inward from an outer diameter measurement to a middle diameter measurement; and a concave surface, the concave surface defined by a curvature and extending inward from the middle diameter measurement to an inner diameter measurement, wherein the curvature is defined by a constant radius measurement through the entire concave surface;

installing the bearing heat shield to a bearing housing; and installing a turbine housing to sandwich the outer annular ring of the bearing heat shield between the bearing housing and the turbine housing.

14. The method of claim 13, wherein the bearing heat shield further includes an aperture from the inner diameter measurement to a center, and the method further comprises press fitting the aperture to an inside wall of the bearing housing.

15. The method of claim 13, wherein a first difference between the middle diameter measurement and the inner diameter measurement is between five to ten times a second difference between the outer diameter measurement and the middle diameter measurement.

16. The method of claim 13, wherein the turbine housing comprises a dual volute turbine housing.

17. The method of claim 16, wherein the bearing heat shield comprises a resonant frequency between 4 kHz and 6.6 kHz.

18. The bearing heat shield of claim 1, wherein:

a ratio of the outer diameter measurement to the middle diameter measurement is substantially 60:55;

a ratio of the middle diameter measurement to the inner diameter measurement is substantially 55:30; and a ratio of the outer diameter measurement to a thickness of the heat shield is substantially 60:1.

* * * * *